US009807538B2

(12) United States Patent
McGrath et al.

(10) Patent No.: US 9,807,538 B2
(45) Date of Patent: Oct. 31, 2017

(54) SPATIAL AUDIO PROCESSING SYSTEM AND METHOD

(71) Applicant: Dolby Laboratories Licensing Corporation, San Francisco, CA (US)

(72) Inventors: David S. McGrath, Rose Bay (AU); Nicholas Claude Mariette, Randwick (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/028,008

(22) PCT Filed: Oct. 2, 2014

(86) PCT No.: PCT/US2014/058907
§ 371 (c)(1),
(2) Date: Apr. 7, 2016

(87) PCT Pub. No.: WO2015/054033
PCT Pub. Date: Apr. 16, 2015

(65) Prior Publication Data

US 2016/0255454 A1 Sep. 1, 2016

Related U.S. Application Data

(60) Provisional application No. 61/887,905, filed on Oct. 7, 2013, provisional application No. 61/985,244, filed on Apr. 28, 2014.

(51) Int. Cl.
*H04S 7/00* (2006.01)
*H04S 5/00* (2006.01)
(Continued)

(52) U.S. Cl.
CPC ..... *H04S 7/308* (2013.01); *G10L 19/167* (2013.01); *H04S 3/00* (2013.01); *H04S 5/005* (2013.01); *H04S 2400/11* (2013.01)

(58) Field of Classification Search
None
See application file for complete search history.

(56) References Cited

U.S. PATENT DOCUMENTS 7,684,578 B2 3/2010 Roeder
7,706,543 B2 4/2010 Daniel
(Continued)

FOREIGN PATENT DOCUMENTS

CN 1826838 8/2006
CN 101669167 3/2010
(Continued)

OTHER PUBLICATIONS

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

(Continued)

*Primary Examiner* — Curtis Kuntz
*Assistant Examiner* — Kenny Truong
(74) *Attorney, Agent, or Firm* — Fish & Richardson P.C.

(57) ABSTRACT

A spatial audio processing system and method including the steps of: dividing the series of virtual speakers into a series of horizontal planes around the expected listener; rendering the audio source to an intermediate spatial format for playback over a series of virtual speakers arranged in each of the series of planes around the listener, the rendering including: an initial panning of the spatialized virtual audio source to each of the horizontal planes to produce a plane rendered audio emission; a subsequent panning of each of the plane rendered audio emissions to a series of virtual speaker locations within each plane, with the subsequent panning utilizing a series of panning curves which are spatially smoothed to can include spatial frequency compo-
(Continued)

nents which are less than the Nyquist sampling rate of the audio source.

15 Claims, 6 Drawing Sheets

(51) Int. Cl.
*G10L 19/16* (2013.01)
*H04S 3/00* (2006.01)

(56) References Cited

U.S. PATENT DOCUMENTS

| | | | | |
|---|---|---|---|---|
| 8,437,485 | B2 | 5/2013 | Kuhn-Rahloff | |
| 8,462,966 | B2 | 6/2013 | Steffens | |
| 2002/0172370 | A1* | 11/2002 | Ito | H04S 3/00 381/18 |
| 2012/0237063 | A1 | 9/2012 | Korn | |
| 2013/0148812 | A1 | 6/2013 | Corteel | |
| 2014/0219456 | A1* | 8/2014 | Morrell | H04S 5/00 381/17 |

FOREIGN PATENT DOCUMENTS

| | | |
|---|---|---|
| CN | 101874414 | 10/2010 |
| CN | 102326417 | 1/2012 |
| CN | 102440003 | 5/2012 |
| CN | 102726066 | 10/2012 |
| RS | 1332 U | 8/2013 |
| WO | 2008/113428 | 9/2008 |
| WO | 2013/006330 | 1/2013 |
| WO | 2013/149867 | 3/2013 |
| WO | 2013/068402 | 5/2013 |
| WO | 2013/108200 | 7/2013 |

OTHER PUBLICATIONS

Stanojevic, Tomislav "Surround Sound for a New Generation of Theaters," Sound and Video Contractor, Dec. 20, 1995, 7 pages.
Stanojevic, Tomislav "Virtual Sound Sources in the Total Surround Sound System," SMPTE Conf. Proc.,1995, pp. 405-421.
Stanojevic, Tomislav et al. "Designing of TSS Halls," 13th International Congress on Acoustics, Yugoslavia, 1989, pp. 326-331.
Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.
Stanojevic, Tomislav et al. "The Total Surround Sound (TSS) Processor," SMPTE Journal, Nov. 1994, pp. 734-740.
Stanojevic, Tomislav et al. "The Total Surround Sound System (TSS System)", 86th AES Convention, Hamburg, Germany, Mar. 7-10, 1989, 21 pages.
Stanojevic, Tomislav et al. "TSS Processor" 135th SMPTE Technical Conference, Los Angeles Convention Center Los Angeles, California, Society of Motion Picture and Television Engineers, Oct. 29-Nov. 2, 1993, 22 pages.
Stanojevic, Tomislav et al. "TSS System and Live Performance Sound" 88th AES Convention, Montreux, Switzerland, Mar. 13-16, 1990, 27 pages.

* cited by examiner

SPATIAL AUDIO PROCESSING SYSTEM AND METHOD

CROSS-REFERENCE TO RELATED APPLICATIONS

This application claims the benefit of priority to U.S. Provisional Patent Application No. 61/887,905 filed 7 Oct. 2013 and U. S. Provisional Patent Application No. 61/985,244 filed 28 Apr. 2014, each of which is hereby incorporated by reference in its entirety.

FIELD OF THE INVENTION

The present invention relates to the field of audio signal processing and, in particular, discloses an efficient form of spatial audio rendering and distribution.

BACKGROUND OF THE INVENTION

Any discussion of the background art throughout the specification should in no way be considered as an admission that such art is widely known or forms part of common general knowledge in the field.

Audio and visual experiences are becoming increasingly complex. In particular, the spatialization of audio material around a listener has progressed with increasing levels of complexity. From the historical mono, stereo and other audio systems, the art has recently seen the introduction of almost full spatialization of the audio sources around the listener in production systems.

FIG. 1 illustrates schematically the simplified structure 1 of creation and playback of a general audio visual presentation. Initially, a content creation system is provided to author audio visual presentations 2. The authoring normally involves spatialization and synchronisation of a number of audio sources around a listener. The overall presentation is then initially 'rendered' 3 into one or more file forms 4 containing the audio and visual information for playback to a listener/viewer.

The rendered file is then distributed for playback over various media rendering environments. Unfortunately, the playback environments can be highly variable in their infrastructure. The rendered file is then rendered for playback in the particular environment by a corresponding rendering engine 5 which outputs speaker and display signals for playback by a series of speakers 6 and visual display elements 7 for recreation of the intended audio visual experience around a viewer.

One particular audio spatialization system is the Dolby Atmos™ system which allows the audio content creator of an audio visual experience to localise a plethora of audio sources around the listener. Subsequent rendering by the rendering engine of that audio material by signal processing units and audio emissions sources allows for the replication of the intentions of the content creator in spatializing the audio sources in positions around the listener.

The actual audio emissions sources (or speakers) placed around a listener in a listening environment may be variable and location specific. For example, movie theatres may include a plethora of speakers placed around the listener in different relative positions. In a home environment, the speaker arrangement may be substantially different. Ideally, the created content is able to be rendered to variable speaker arrays so as to reproduce the intentions of the original content creator.

The rendering of a series of audio sources to a speaker array such as that provided by the Dolby Atmos system is likely to significantly tax the computational resources of any rendering system.

There is therefore a general need to provide for a simplified audio rendering system at the point of delivery.

SUMMARY OF THE INVENTION

In accordance with a first aspect of the present invention, there is provided a method of rendering at least one spatialized virtual audio source around an expected listener, to a series of intermediate virtual speaker channels (virtual speakers) around the listener, the method including the step of: rendering the audio source to an intermediate spatial format for playback over a series of virtual speakers arranged in a series of planes around the listener, wherein the rendering to the virtual speakers within each plane utilises a series of panning curves which are spatially smoothed to a degree satisfying the Nyquist sampling theorem.

The series of planes can include at least a horizontal plane substantially around a listener and a ceiling plane spatially above a listener. The virtual speakers within each plane can be arranged in equally spaced angular intervals around the listener. The virtual speakers can be arranged equidistant from the expected listener.

In accordance with a further aspect of the present invention, there is provided a method of rendering at least one spatialized virtual audio source, located around an expected listener, to a series of virtual speakers around the expected listener, the method including the step of: (a) dividing the series of virtual speakers into a series of horizontal planes around the expected listener; (b) rendering the audio source to an intermediate spatial format for playback over a series of virtual speakers arranged in each of the series of planes around the listener, the rendering including: (i) an initial panning of the spatialized virtual audio source to each of the horizontal planes to produce a plane rendered audio emission; (ii) a subsequent panning of each of the plane rendered audio emissions to a series of virtual speaker locations within each plane, with the subsequent panning utilising a series of panning curves which are spatially smoothed to include spatial frequency components which are less than the Nyquist sampling rate of the audio source.

The initial panning can include a discrete panning between the series of horizontal planes.

In accordance with a further aspect of the present invention, there is provided a method of playback of an intermediate spatial format signal, the signal divided into a first series of channels defining a number of listening planes with each listening plane including a series of virtual audio sources spaced around the plane, the method including the steps of: remapping the location of the speaker audio sources within each plane to map a desired output arrangement of speakers.

In accordance with a further aspect of the present invention there is provided a method of playback of an encoded audio bitstream, the bitstream including an encoding of an intermediate spatial format for playback over a series of virtual speakers arranged in a series of planes around a listener, with the virtual speakers within each plane having virtual speaker bitstreams formed using a series of panning curves which have been spatially smoothed to a degree satisfying the Nyquist sampling theorem, the method including the steps of: (a) decoding the bitstream into a first series of channels each defining a number of listening planes; and within each plane, a series of corresponding virtual speaker signals; (b) mixing the virtual speaker signals utilising a weighted sum of the virtual speaker signals to produce a set of remapped speaker signals, corresponding to an output location of a series of real speakers; and (c) outputting the real speaker signals to a corresponding series of real speakers.

BRIEF DESCRIPTION OF THE DRAWINGS

Embodiments of the invention will now be described, by way of example only, with reference to the accompanying drawings in which.

DETAILED DESCRIPTION

The described embodiments provide for a method of remapping audio objects to a virtual speaker array.

Figure 1:
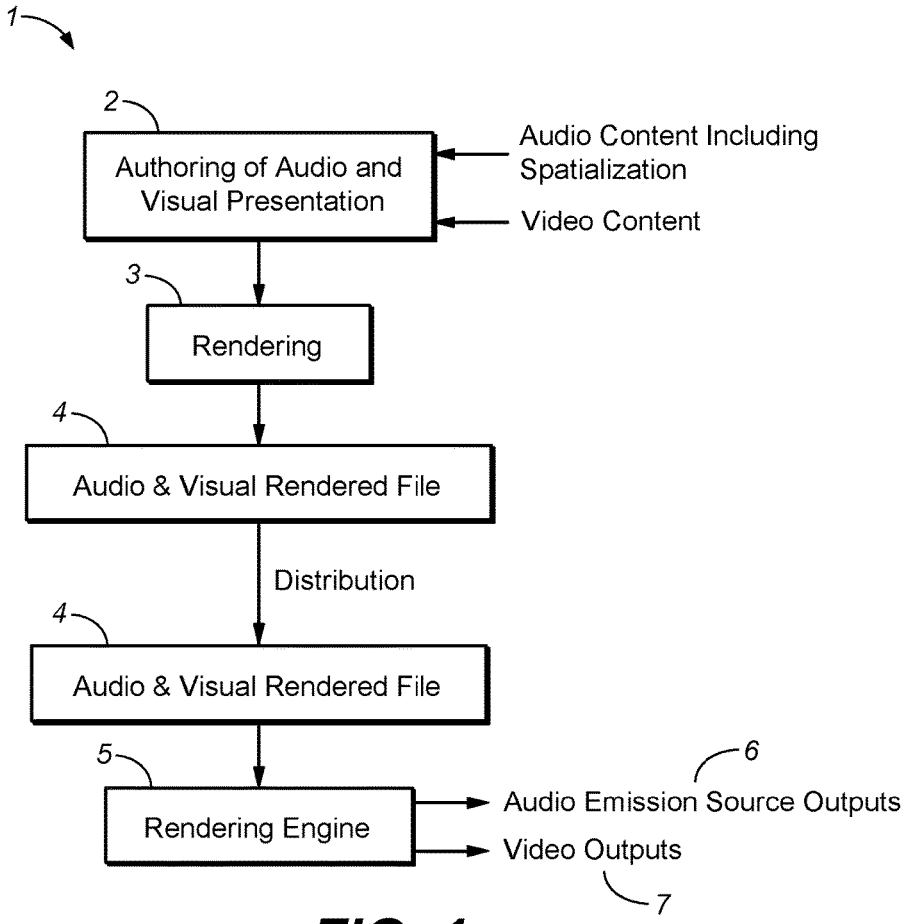
FIG. 1 (PRIOR ART)
FIG. 1 illustrates schematically the process of the creation and playback of an audio visual experience.
Figure 2:
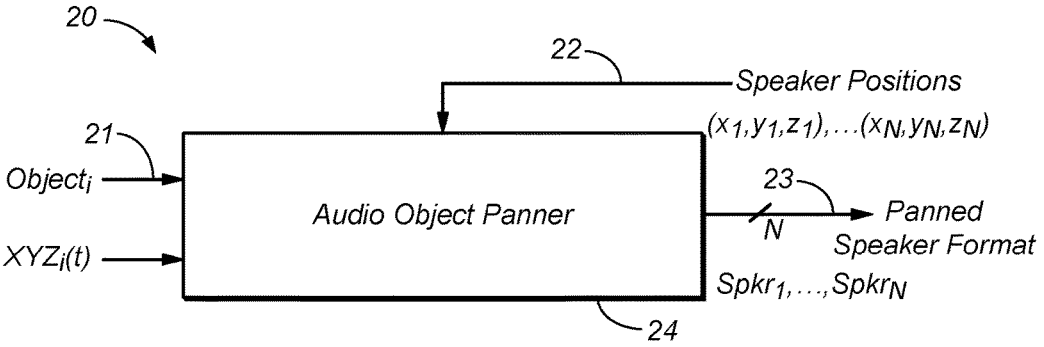
FIG. 2 (PRIOR ART)
FIG. 2 illustrates schematically an audio object panner, making use of object positions and speaker positions.

Turning now to FIG. 2, there is illustrated an audio object panner 20. The audio object panner 20 pans a spatialized audio object to a series of speakers placed around a listener in an audio environment. Taking the case of a single object, the object data information is input 21, which is a monophonic object (e.g. $\text{Object}_i$) at a predetermined time varying location $XYZ_i(t)$ which is panned to N output speakers, whereby the panning gains are determined as a function of the speaker locations, $(x_1, y_1, z_1), \ldots, (x_N, y_N, z_N)$, and the object location, $XYZ_i(t)$. These gain values may vary continuously over time, because the object location can also be time varying. An audio object panner therefore requires significant computational resources to perform its function.

The described embodiments provide for an intermediate spatial format structure that reduces the computational resources required for object panning whilst still preserving the playback ability over multiple speaker environments.

Figure 3:
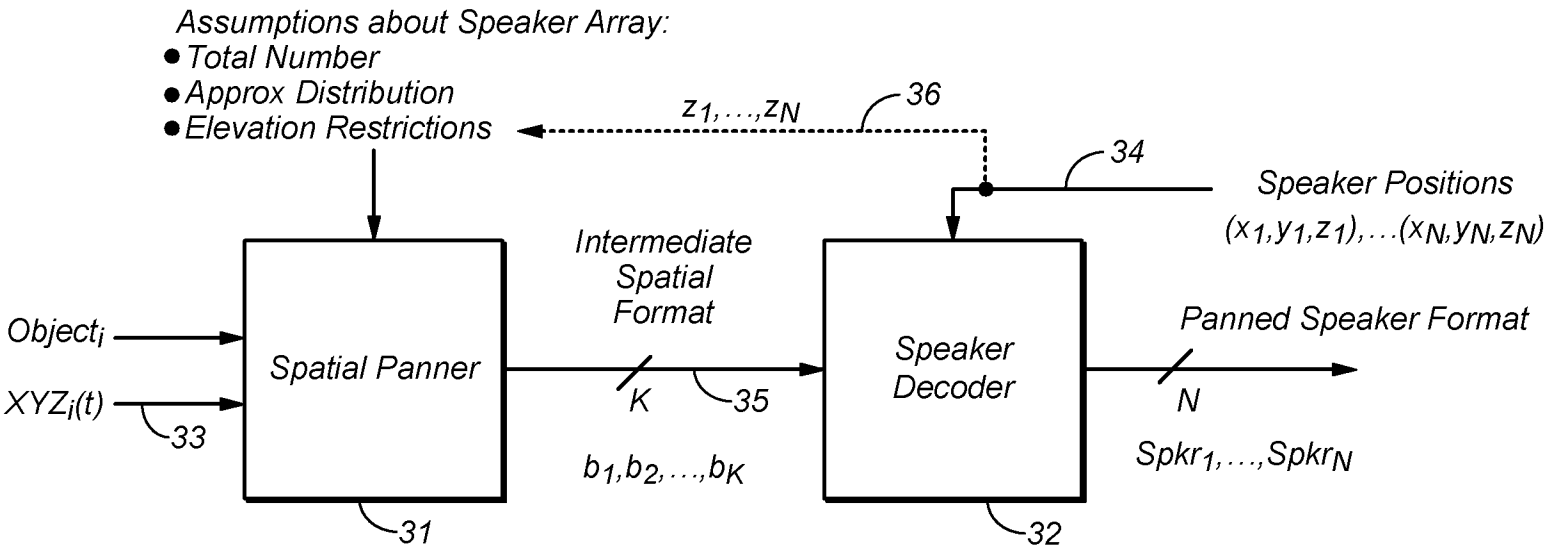
FIG. 3 illustrates schematically the operation of a Spatial Panner, with the encoder given information regarding speaker heights.

The operational aspects of the described embodiments are illustrated 30 in FIG. 3. The embodiments use an Intermediate Spatial Format that splits the panning operation into two parts 31, 32. The first part, referred to as a spatial panner 31, is time varying and makes use of the object location 33. The second part, the speaker decoder 32 utilises a fixed matrix decoding and is configured based on the custom speaker locations 34. In between these two processing blocks, the audio object scene is represented in a K-channel Intermediate Spatial Format (ISF) 35. Multiple audio objects ($1<=i<=N_i$) may be processed by individual Spatial Panners with the outputs of the Spatial Panners being summed together to form ISF signal 35, so that one K-channel ISF signal set may contain a superposition of $N_i$ objects.

The spatial panner 31 is not given detailed information about the location of the playback speakers. However, an assumption is made of the location of a series of 'virtual speakers' which are restricted to a number of levels or layers and approximate distribution within each level or layer.

Whilst the Spatial Panner is not given detailed information about the location of the playback speakers, there will often be some reasonable assumptions that can be made regarding the likely number of speakers, and the likely distribution of those speakers.

The quality of the resulting playback experience (i.e. how closely it matches the audio object panner of FIG. 2) can be improved by either increasing the number of channels, K, in the ISF, or by gathering more knowledge about the most probable playback speaker placements. In particular, in an embodiment, the speaker elevations are divided into a number of planes.

A desired composed soundfield can be considered as a series of sonic events emanating from arbitrary directions around a listener. The location of the sonic events can be considered to be defined on the surface of a sphere with the listener at the center. A soundfield format such as Higher Order Ambisonics is defined in such a way to allow the soundfield to be further rendered over (fairly) arbitrary speaker arrays. However, typical playback systems envisaged are likely to be constrained in the sense that the elevations of speakers are fixed in 3 planes (an ear-height plane, a ceiling plane, and a floor plane). Hence, the notion of the ideal spherical soundfield can be modified, where the soundfield is composed of sonic objects that are located in rings at various heights on the surface of a sphere around the listener.

Figure 4:
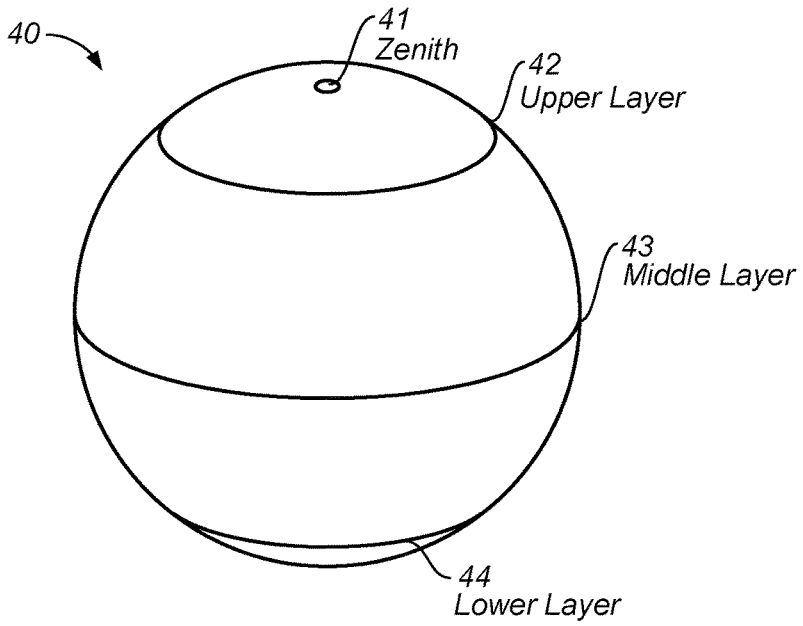
FIG. 4 illustrates the 4 layers that make up an example Stacked-Ring Format panning space.

For example, one such arrangement of rings is illustrated 40 in FIG. 4, with a zenith ring 41, an upper layer ring 42, middle layer ring 43 and lower ring 44. If necessary, for the purpose of completeness, an additional ring at the bottom of the sphere can also be included (the Nadir, which is also a point, not a ring, strictly speaking). Moreover, additional or lessor numbers of rings may be present in other embodiments.

Figure 5:
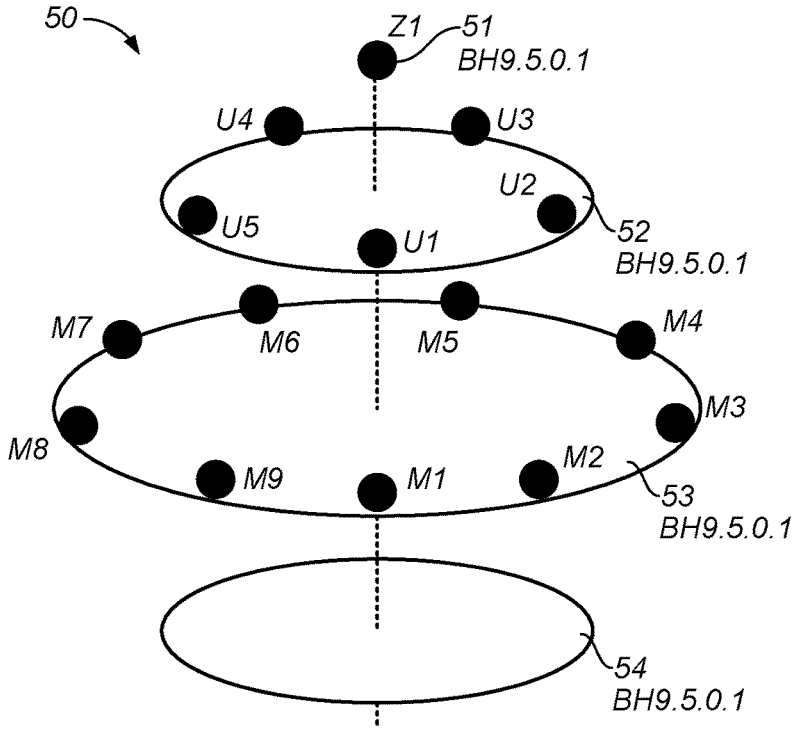
FIG. 5 illustrates the 4 rings of nominal speakers arranged in anti-clockwise order.

FIG. 5 illustrates one form of speaker arrangement 50 having four rings 51-54 in a stacked ring format. The arrangement is denoted: BH9.5.0.1, where the four numbers indicate the number of speaker channels in the Middle, Upper, Lower and Zenith rings respectively. The total number of channels in the multi-channel bundle will be equal to the sum of these four numbers (so the BH9.5.0.1 format contains 15 channels).

Another example format, which makes use of all four rings, is BH15.9.5.1. For this format, the channel naming and ordering will be as follows: [M1,M2, . . . M15, U1,U2 . . . U9, L1,L2, . . . L5, Z1], where the channels are arranged in rings (in M, U, L, Z order), and within each ring they are simply numbered in ascending cardinal order. Therefore, each ring can be considered to be populated by a set of nominal speaker channels that are uniformly spread around the ring. Hence, the channels in each ring correspond to specific decoding angles, starting with channel 1, which will correspond to the 0° azimuth (directly in front) and enumerating in anti-clockwise order (so channel 2 will be to the left of centre, from the listener's viewpoint). Hence, the azimuth angle of channel n is: (n−1)/N×360° (where N is the number of channels in that ring, and n is in the range from 1 to N).

The output virtual speaker signals can be referred to as "Nominal Speaker Signals" because they look like signals that are destined to be decoded to a particular speaker arrangement, but they can be also repurposed to an alternative speaker layout in the speaker decoder.

It will be understood by those skilled in the art that, in an alternative embodiment, the virtual speaker channels in one layer may be translated, by a reversible matrix operation, into a number of 'alternate' audio channels, such that the original virtual speaker channel could be recovered from the 'alternate' channels by an inverse matrix mapping. One such 'alternate' channel format is known the art as B-Format (more specifically, horizontal B-format). Many references, in this specification, to the desirable properties of groups of virtual speakers, would apply equally to B-format signals.

The Intermediate Speaker Format can therefore be characterised by the following features:

1) the use of 2 or more rings to encode a spatial audio scene, wherein different rings represent different spatially separate components of the soundfield; wherein the audio objects are panned within a ring according to Repurposable Panning Curves, and audio objects are panned between rings using Non-Repurposable Panning Curves (these terms are defined below);

2) Wherein the "different spatially separate components" are separated on the basis of their vertical axis (i.e. as vertically stacked rings).

3) Transmission of the soundfield elements within each ring, in the form of intermediate virtual speaker channels is provided or, transmission of the soundfield elements within each ring, in the form of spatial frequency components (such as B-format signals);

5) Creation of decoding matrices for each ring by stitching together precomputed sub-matrices that represent segments of the ring;

6) Precomputed sub-matrices that are deliberately 'sparse', to avoid LF build-up issues;

7) Redirecting the sound from one ring to another ring if speakers are not present in the first ring;

The embodiments rely on aspects of 'repurposable' and 'non-repurposable' speaker panning. The location of each speaker in a playback array can be expressed in terms of: (x, y, z) coordinates (this is the location of each speaker relative to a candidate listening position that is close to the center of the array). Furthermore, the (x, y, z) vector can be converted into a unit-vector, to effectively project each speaker location onto the surface of a unit-sphere:

$$Speakerlocation:\ V_n = \begin{bmatrix} x_n \\ y_n \\ z_n \end{bmatrix} \{1 \le n \le N\} \quad \text{(Equation No. 1)}$$

$$Speakerunitvector:\ U_n = \frac{1}{\sqrt{V_n^T \times V_n}} \times V_n \quad \text{(Equation No. 2)}$$

Figure 6:
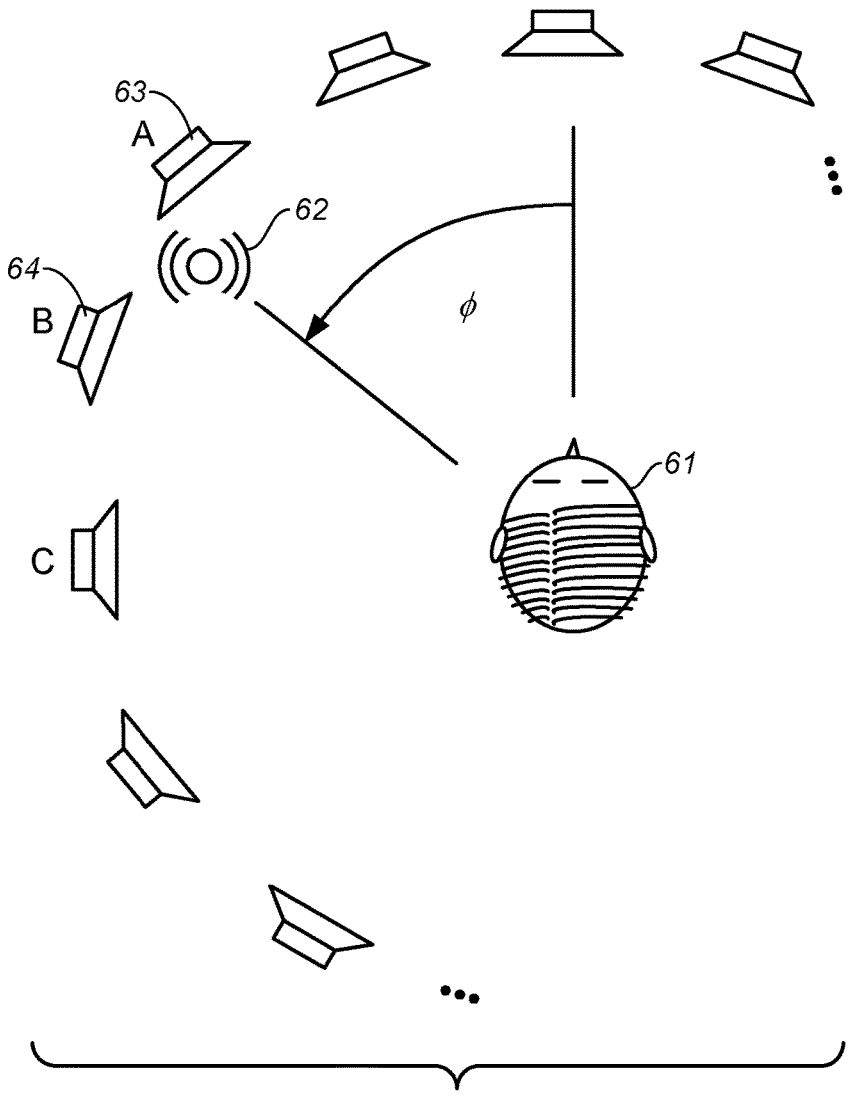
FIG. 6 illustrates an arc of speakers, with an audio object panned to angle q.

With reference to FIG. 6, considering the scenario where an audio object 62 is panned sequentially through a number of speakers e.g. 63, 64 (where the listener 61 is intended to experience the illusion of an audio object 62 that is moving through a trajectory that passes through each speaker in sequence), without loss of generality, it can be assumed that the unit-vectors of these speakers are arranged along a ring in the horizontal plane, so that the location of the audio object may be defined as a function of its azimuth angle, $\phi$. In the arrangement of FIG. 6, the audio object 62 angle $\phi$, passes through speakers A, B and C (where these speakers are located at azimuth angles $\phi_A$, $\phi_B$ and $\phi_C$ respectively).

Figure 7:
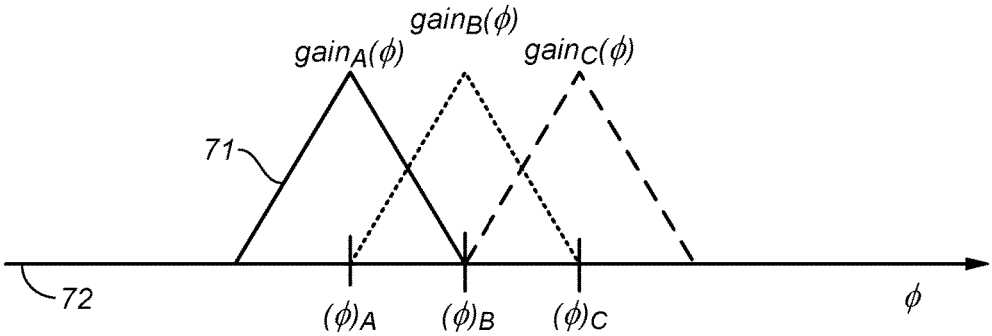
FIG. 7 (PRIOR ART)
FIG. 7 illustrates panning curves for an object with a trajectory that passes through speakers A, B and C.

An Audio Object Panner (such as that shown in FIG. 2), will typically pan an audio object to each speaker using a speaker-gain that is a function of the angle, $\phi$. FIG. 7 illustrates the typical panning curves e.g. 71 that may be used by an audio object panner. The panning curves shown in FIG. 7 have the properties that when an audio object is panned to a position that coincides with a physical speaker location, the coincident speaker is used to the exclusion of all other speakers, and when an audio-object is panned to angle $\phi$, that lies between two speaker locations, only those two speakers are active, thus providing for a minimal amount of 'spreading' of the audio signal over the speaker array. These properties, of the panning curves shown in FIG. 7, imply that the panning curves exhibit a high level of 'discreteness'. In this context, 'discreteness' refers to the fraction of the panning curve energy that is constrained in the region between one speaker and its nearest neighbours. So, for speaker B:

$$\text{Discreteness: } d_B = \frac{\int_{\phi A}^{\phi C} gain_B(\phi)^2\, d\phi}{\int_0^{2\pi} gain_B(\phi)^2\, d\phi} \quad \text{(Equation No. 3)}$$

Hence, $d_B \le 1$. When $d_B = 1$, the panning curve for speaker B is entirely constrained (spatially) to be non-zero only in the region between $\phi_A$ and $\phi_C$ (the angular positions of speakers A and C, respectively).

Figure 8:
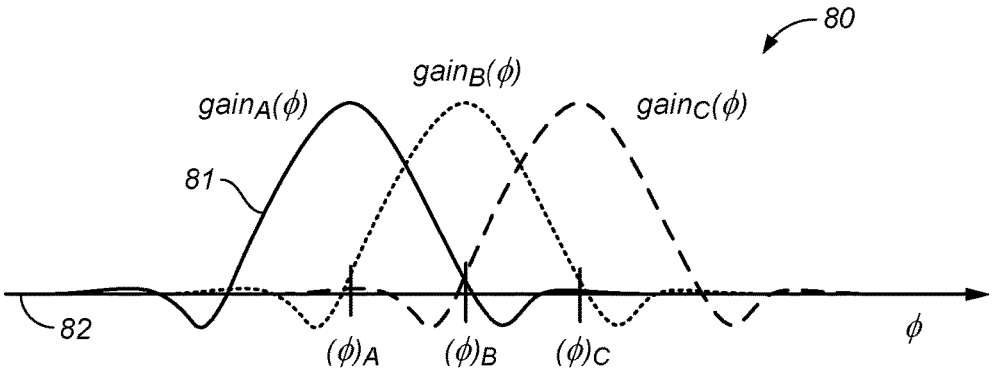
FIG. 8 illustrates a panning curve for a repurposeable speaker array.

In contrast, an alternative set of panning curves are shown 80 in FIG. 8. These panning curves do not exhibit the 'discreteness' properties described above (i.e. $d_B \le 1$), but they exhibit one important property that the panning curves are spatially smoothed, so that they are constrained in spatial frequency, so as to satisfy the Nyquist sampling theorem.

For example, each panning curve (such as 81 in FIG. 8) can be considered to be formed by a Fourier series with F terms (F=9 in this example):

$$gain_A(\phi) = c_0 + c_1 * \cos(\phi) + s_1 * \sin(\phi) + c_2 * \cos(2*\phi) + s_2 * \sin(2*\phi) + c_3 * \cos(3*\phi) + s_3 * \sin(3*\phi) + c_4 * \cos(4*\phi) + s_4 * \sin(4*\phi)$$

This can be represented by the audio for a ring in the form of N signals. If the number of virtual speakers, N, is greater than or equal to the number of frequency components, F, then the Nyquist sampling theorem is satisfied, as the set of N speakers will have formed a complete spatial sampling of the audio around the ring.

Any panning curve that is spatially band-limited cannot be compact in its spatial support. In other words, these panning curves will spread over a wider angular range, as can be seen in the 'stop-band-ripple' e.g. 82 of the curve e.g. 81 in FIG. 8. This terminology borrows from filter-design theory, where the term 'stop-band-ripple' refers to the (undesirable) non-zero gain in the region of the filter operation where the gain is expected to go to zero. In this instance, the term 'stop-band-ripple' refers to the (undesirable) non-zero gain that occurs 82 in the panning curves of FIG. 8 in the angular regions 72 where the 'ideal' curves of FIG. 7 go to zero. By satisfying the Nyquist sampling criterion, these panning curves e.g. 81 suffer from being less 'discrete' (another way of saying that they spread out more than the 'ideal' curves of FIG. 7).

However, there is one important benefit that comes from using these curves. Being properly 'Nyquist-sampled', these panning curves can be shifted to alternative speaker locations. This means that a set of speaker signals that have been created for a particular arrangement of N speakers (that are evenly spaced in a circle) can be remixed (by an N×N matrix) to an alternative set of N speakers at different angular locations (i.e. the speaker array can be rotated to a new set of angular speaker locations, and it is possible to re-purpose the original N speaker signals to the new set of N speakers).

In general, this 're-purposability' property allows for the remapping of the N speaker signals, through an S×N matrix, to S speakers, provided that, for the case where S>N, the new speaker feeds will not be any more 'discrete' that the original N channels.

This leads us to the following definitions: Repurposable Panning curves: Panning curves that are Nyquist-sampled, so as to allow alternative speaker placements to be targeted at a later processing stage; Non-Repurposable Panning Curves: Panning curves that are optimised for discreteness, but which are not repurposable to alternative speaker layouts without loss of discreteness. Intermediate Virtual Speaker Channels (virtual speakers): Speaker signals that are generated according to Repurposable Panning Curves.

The described embodiments utilise a system that, where the speaker layout is known, then Non-Repurposable Panning Curves can be used to provide a better (more discrete) end-user listening experience, otherwise Repurposable Panning Curves are used.

The described embodiments provides a Stacked-Ring Intermediate Spatial Format which represents each object, according to its (time varying) (x, y, z) location, by the following steps:

1. Object i is located at ($x_i$, $y_i$, $z_i$) and this location is assumed to lie within a cube (so $|x_i|<1$, $|y_i|\leq 1$ and $|z_i|\leq 1$), or within a unit-sphere ($x_i^2+y_i^2+z_i^2<=1$)

2. The vertical location ($z_i$) is used to pan the audio signal for object i to each of a number (R) spatial regions, according to non-repurposable panning curves.

3. Each spatial region (say, region r:1≤r≤R) (which represents the audio components that lie within an annular region of space, as per FIG. 4), is represented in the form of $N_r$ Nominal Speaker Signals, being created using Repurposable Panning Curves that are a function of the azimuth angle of object i ($\phi_i$). For the special case of the zero-size ring (the zenith ring, as per FIG. 4), step 3 above is simplified, as the ring will contain a maximum of one channel.

These steps can be performed as a preliminary rendering of the spatialized audio signals to the Intermediate Spatial format.

Decoding the Stacked-Ring Intermediate Spatial Format

The decoding process for the Stacked-Ring ISF format can operate as a matrix-mixer, so each speaker feed is made from the weighted sum of ISF signals. For example, the BH9.5.0.0 format is decoded to N speakers via the following matrix mixer:

$$\begin{bmatrix} Spkr_1 \\ Spkr_2 \\ \vdots \\ Spkr_N \end{bmatrix} = \begin{bmatrix} G_{1,M1} & \dots & G_{1,M9} & G_{1,U1} & \dots & G_{1,U5} \\ \vdots & \ddots & \vdots & \vdots & \ddots & \vdots \\ G_{N,M1} & \dots & G_{N,M9} & G_{N,U1} & \dots & G_{N,U5} \end{bmatrix} \times \begin{bmatrix} M_1 \\ \vdots \\ M_9 \\ U_1 \\ \vdots \\ U_5 \end{bmatrix}$$

In practice, it is possible to restrict speaker to be located in one of several planes. For example, if the first $N_M$ speakers are located on the middle (ear-level) plane, and the other $N-N_M$ speakers are located around the ceiling plane, the matrix becomes more sparse. The matrix below showing the case where the Stacked-Ring format consists of only 2 rings, and all speakers are located in 2 horizontal planes that correspond to those two rings:

$$\begin{bmatrix} S_1 \\ \vdots \\ S_{N_M} \\ S_{N_M+1} \\ \vdots \\ S_N \end{bmatrix} = \begin{bmatrix} G_{1,M1} & \dots & G_{1,M9} & 0 & \dots & 0 \\ \vdots & \ddots & \vdots & \vdots & \ddots & \vdots \\ G_{N_M,M1} & \dots & G_{N_M,M9} & 0 & \dots & 0 \\ 0 & \dots & 0 & G_{N_M+1,U1} & \dots & G_{N_M+1,U5} \\ \vdots & \ddots & \vdots & \vdots & \ddots & \vdots \\ 0 & \dots & 0 & G_{N,U1} & \dots & G_{N,U5} \end{bmatrix} \times \begin{bmatrix} M_1 \\ \vdots \\ M_9 \\ U_1 \\ \vdots \\ U5 \end{bmatrix}$$

Figure 9:
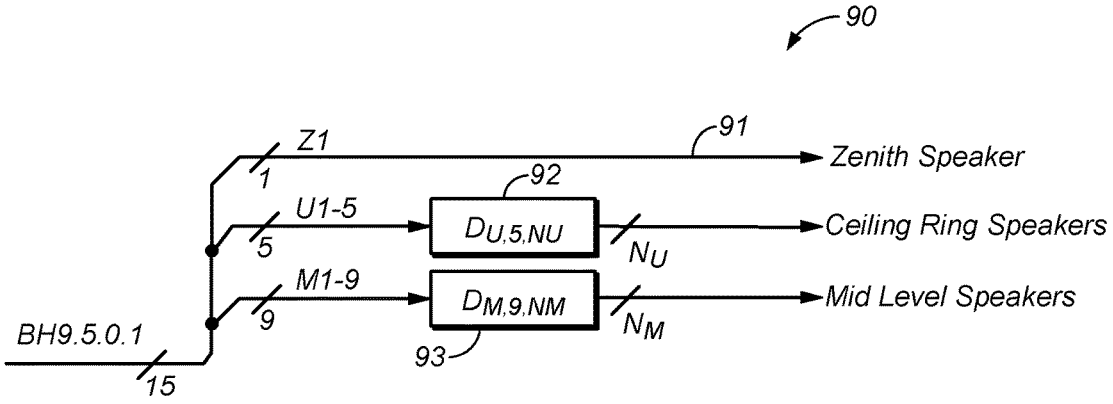
FIG. 9 illustrates a decoder for decoding a Stacked Ring Format as separate rings.

FIG. 9 shows an example of a decoder structure where the Zenith ring also exists in the Stacked Ring ISF format (BH9.5.0.1), and a Zenith speaker is included in the playback speaker array. The zenith data is passed 91 directly to the output speaker. The zenith position can be considered a special kind of 'speaker plane', consisting of only one speaker position. The ceiling and mid-level speakers are fed to matrix mixing decoders 92, 93 respectively.

The processing elements shown in FIG. 9 are linear matrix mixers, with the name of the matrix defined as in this example: $D_{U,5,NU}$ is a $N_U$×5 matrix that decodes 5 channels from the upper ring of an ISF signal, to $N_U$ output speakers.

Figure 10:
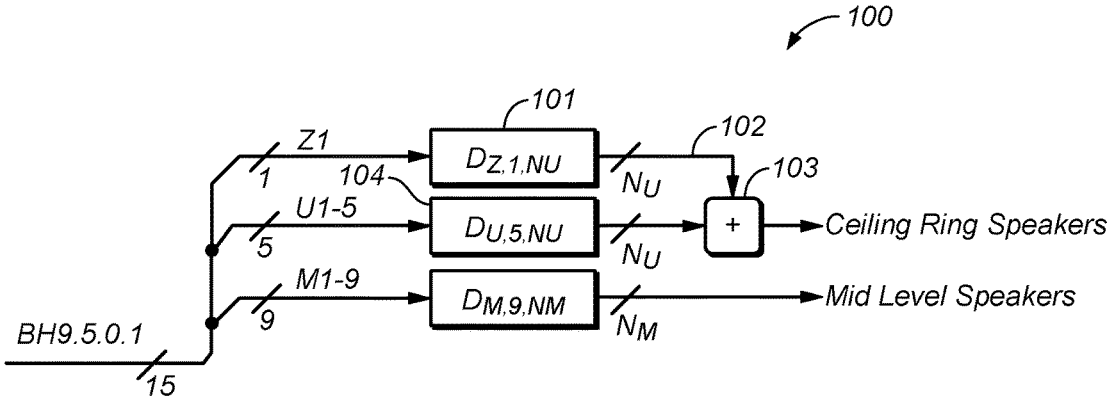
FIG. 10 illustrates a decoder for decoding a Stacked Ring Format where no zenith speaker is present.

If the Zenith speaker is absent, then the Z1 channel of the ISF signal must be 'decoded' to the other (non-zenith) ceiling speakers. Such an arrangement is illustrated 100 in FIG. 10 wherein the zenith signal is decoded 101 into $N_u$ output signals 102 which are added 103 to the outputs from the ceiling decoder 104.

Figure 11:
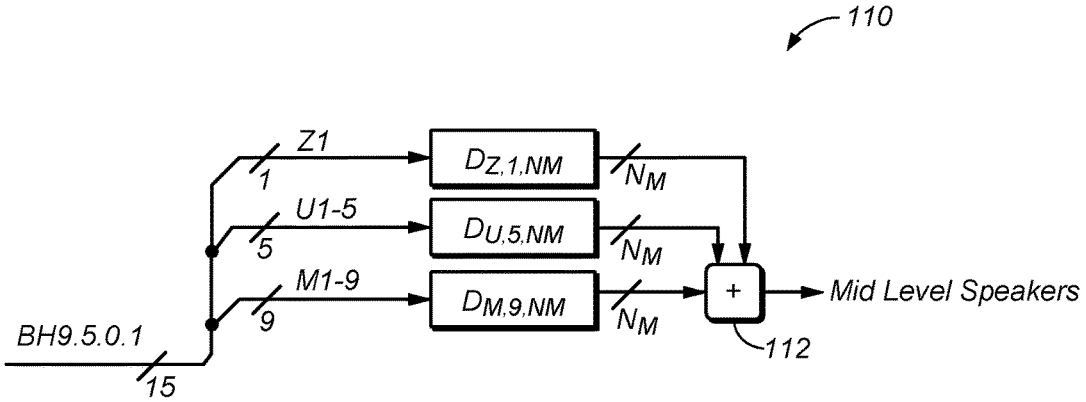
FIG. 11 illustrates a decoder for decoding a Stacked Ring Format where no zenith or ceiling speakers are available.

In a further example, illustrated in FIG. 11, if the playback speaker array contains no speakers on the ceiling, then all channels may be mixed 112 into the middle layer speakers.

It can be seen in that the described embodiment allows for the separation of the audio rendering process into two distinct components. Initially the spatialized audio input sources can be rendered into the intermediate spatialized format having a series of predetermined speaker planes each with a virtual speaker layout. Subsequently, the intermediate spatialized format can be decoded by means of separate decoding units for a custom variable form of output speaker array. The decoding units can be incorporated into a DSP type environment and have reduced computational requirements compared a full spatialized audio source decoder, which still maintaining the perception of spatialized audio sources.

The intermediate spatial format is generally repurposable in azimuth and non-repurposeable in elevation.

The intermediate spatial format also has a further advantage in that it is suitable for utilisation in echo cancelling systems. With a full spatialization of dynamic audio objects (e.g. FIG. 2), there is a difficulty in that echo cancelling systems cannot operate on the audio sources. However, the Intermediate Spatial Format provides a virtualised speaker rendering of the spatial audio sources. The virtualized speaker rendering creates virtual speaker signals that are decoded to playback speakers in a linear time invariant manner. As such, the signal can then be fed to an echo canceller as a series of virtual speaker outputs and the echo canceller can conduct echo cancelling operations on the basis of the virtual speaker outputs.

Interpretation

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

As used herein, the term "exemplary" is used in the sense of providing examples, as opposed to indicating quality. That is, an "exemplary embodiment" is an embodiment provided as an example, as opposed to necessarily being an embodiment of exemplary quality.

It should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A method of rendering at least one spatialized virtual audio source, located around an expected listener, to a series of virtual speakers around said expected listener, the method comprising:

dividing the series of virtual speakers into a series of horizontal planes around the expected listener;

rendering the audio source to an intermediate spatial format for playback over a series of virtual speakers arranged in each of the series of planes around the listener, the rendering including:

an initial panning of the spatialized virtual audio source to each of the horizontal planes to produce a plane rendered audio emission;

a subsequent panning of each of the plane rendered audio emissions to a series of expected virtual speaker locations within each plane, with the subsequent panning utilizing a series of panning curves which are constructed from a Fourier series, the number of frequency components in the Fourier series being less than or equal to a number of virtual speakers in the series of virtual speakers.

2. The method of claim 1 wherein the initial panning includes a discrete panning between said series of horizontal planes.

3. The method of any of claims 1-2 wherein the audio source comprises at least one audio object and metadata describing the position of the at least one audio object.

4. The method of any of claims 1-3 wherein the audio source comprises multiple audio objects and the multiple audio objects are summed together to generate the intermediate spatial format.

5. The method of any of claims 1-3 wherein the intermediate spatial format contains K channels and at least one of the K channels channel represents a superposition of audio objects.

6. The method of claim 1 wherein the series of horizontal planes represent discrete horizontal planes where height speakers are likely to be located.

7. The method of claim 1 wherein the series of horizontal planes includes at least two planes wherein at least one of the at least the two planes is substantially around the listener and another one of the at least the two planes is a ceiling plane spatially above the listener.

8. The method of claim 1 wherein the series of horizontal planes are substantially parallel to each other.

9. A method of rendering at least one spatialized virtual audio source around an expected listener, to a series of virtual speakers around said expected listener, the method comprising:

rendering the audio source to an intermediate spatial format for playback over a series of virtual speakers arranged in a series of planes around the listener, wherein the rendering to the virtual speakers within each plane utilizes a series of panning curves which are constructed from a Fourier series, the number of frequency components in the Fourier series being less than or equal to a number of virtual speakers in the series of virtual speakers.

10. The method of claim 9 wherein the series of planes include at least a horizontal plane substantially around the listener and a ceiling plane spatially above the listener.

11. The method of claim 1 wherein the speakers within each plane are arranged in equally spaced angular intervals around the listener.

12. The method of claim 1 wherein the expected speaker locations are arranged equidistant from the expected listener.

13. A method of playback of an encoded audio bitstream, the bitstream including an encoding of an intermediate spatial format for playback over a series of virtual speakers arranged in a series of planes around a listener, with the virtual speakers within each plane having virtual speaker bitstreams formed using a series of panning curves which have been constructed from a Fourier series, the number of frequency components in the Fourier series being less than or equal to a number of virtual speakers in the series of virtual speakers, the method comprising:

(a) decoding the bitstream into a first series of channels each defining a number of listening planes; and within each plane, a series of corresponding virtual speaker signals;

(b) mixing the virtual speaker signals utilizing a weighted sum of the virtual speaker signals to produce a set of remapped speaker signals, corresponding to an output location of a series of real speakers; and (c) outputting the real speaker signals to a corresponding series of real speakers.

14. The method of claim 13 wherein said step (a) further comprises the step of:

merging the virtual speaker signals of at least one adjacent planes into a single plane of virtual speaker signals.

15. A non-transitory computer readable medium that contains instructions that when executed by a processor perform the steps of the method of claim 1.

* * * * *